United States Patent [19]

van Vliet

[11] 3,935,855

[45] Feb. 3, 1976

[54] AIR HEATER, ESPECIALLY FOR CONNECTION TO A CENTRAL HEATING SYSTEM

[75] Inventor: Cors van Vliet, Zwolle, Netherlands

[73] Assignee: N.V. Werktuigenfabrieke Mulder, Netherlands

[22] Filed: Apr. 24, 1974

[21] Appl. No.: 463,588

Related U.S. Application Data

[63] Continuation-in-part of Ser. No. 256,077, May 23, 1972, Pat. No. 3,820,526.

[30] Foreign Application Priority Data

May 24, 1971 Netherlands.....7107090

[52] U.S. Cl...... 126/110 R; 126/116 A; 126/116 R; 236/1 E; 431/171

[51] Int. Cl.[2]..... F24H 3/02

[58] Field of Search..... 126/110 R, 116 A, 110 B, 126/116 R, 116 B; 110/97 D; 165/58, 64; 236/101 A, 1 E, 78 A; 431/171; 137/625.12

[56] References Cited

UNITED STATES PATENTS

| | | | |
|---|---|---|---|
| 732,892 | 7/1903 | Pratt | 126/110 |
| 1,558,848 | 10/1925 | Doble, Jr. | 236/10 |
| 2,292,180 | 8/1942 | Tuck | 126/116 R |
| 2,300,560 | 11/1942 | Faber | 236/1 E |
| 2,381,223 | 8/1945 | Miller | 236/1 A |
| 2,517,446 | 8/1950 | Ryder et al. | 431/202 |
| 2,807,423 | 9/1957 | Eskin | 137/625.12 |
| 2,952,409 | 9/1960 | Matthews | 236/10 |
| 3,138,194 | 6/1964 | Jackson et al. | 236/1 E |
| 3,251,393 | 5/1966 | Beach et al. | 431/171 |
| 3,670,713 | 6/1972 | Abbott | 126/110 R |

*Primary Examiner*—John J. Camby
*Assistant Examiner*—Henry C. Yuen
*Attorney, Agent, or Firm*—Wilkinson, Mawhinney & Theibault

[57] ABSTRACT

Gas fired air heater for a central heating system comprising a heat exchanger in which are arranged a series of parallel rows of vertical heat exchange tubes, the lower ends of which are connected to a joint burner compartment and the upper ends of which are connected to a joint flue compartment. Two opposite lateral sides of the heat exchanger are connected to air supply and discharge compartments respectively for feeding the air to be heated transversely through the heat exchanger. The lateral air supply and discharge compartments have air inlet and outlet connections at their top and bottom walls only. One of said lateral air compartments is closed at one end and is connected to a fan at the opposite end, whereas at least one end of the other lateral air compartment is connected to a main duct for discharge of the heated air. The heat exchange tubes are grouped in three sections, each of which extends transversely to the direction of flow of the air to be heated and each of which is heated by an individual ribbon type burner. Each section is individually controlled, to which end the individual sections may be connected to the successive stages of a multistage room thermostat set at staggered temperatures.

1 Claim, 3 Drawing Figures

AIR HEATER, ESPECIALLY FOR CONNECTION TO A CENTRAL HEATING SYSTEM

This application is a continuation-in-part application of Ser. No. 256,077, filed May 23, 1972, U.S. Pat. No. 3,820,526, for AIR HEATER ESPECIALLY FOR CONNECTION TO A CENTRAL HEATING SYSTEM.

DISCUSSION OF THE PRIOR ART

The invention relates to an air heater comprising a heat exchanger compartment in which are arranged a series of parallel rows of vertical heat exchange tubes, the lower ends of which are connected to a joint burner compartment and the upper ends of which are connected to a joint flue compartment, whereas two opposite lateral sides of the heat exchanger compartment are connected to air supply and discharge compartments respectively for feeding the air to be heated transversely through said heat exchanger compartment. This heater will be further referred to as a heater of the kind specified. The heater may be gas fired and the heat exchange tubes may comprise finned tubes.

SUMMARY OF THE INVENTION

According to one aspect of the invention, said lateral air supply and discharge compartments of a heater of the kind specified have air inlet and outlet connections at their top and bottom walls only, one of said connection being connected to a fan for feeding the air to be heated into the relative compartment, the other connection of the same compartment being closed, at least one of the connections of the other lateral compartment being connected to a discharge duct for the heater air.

This provides the advantage that the heater can be installed in a narrow space, since the air connections are at the top and bottom of the heater only. Moreover, the arrangement of the air connections can easily be adapted to the situation on hand, since the fan connection and the air discharge duct connection can be made at any of the four available locations, either at the right or at the left or either at the top or at the bottom of the heater, provided that the fan connection is made at the other compartment than the one with which the discharge duct is connected.

According to another aspect of the invention, a heater of the kind specified is characterized in that a separate burner is provided for each individual row of heat exchange tubes situated transversely of the direction of flow of the air to be heated and each burner is separately controlled by an individual thermostat stage such that a next burner is added to the operating set of burners when the capacity thereof becomes insufficient and vice versa.

In this embodiment, switching on and off of a next burner can be done manually, for instance at the change of seasons, but it is preferably obtained automatically by using a multistage thermostat, each of the stages of which controls an other burner or an other group of burners respectively.

A multistage control of the heat capacity is especially important for an air heater, since the circulating air of an air operated central heating plant has a very small heat content as compared to a hot water operated central heating plant, so that an ordinary on-off operation of an air heater would cause unacceptable temperature fluctuation in the rooms to be heated. On the other hand, a gradual control of the pressure of the gas fed to the gas burners has also disadvantages such as condensation and low efficiency of the throttled flames. By the use of a multistage control, these disadvantages are prevented whereas the control apparatus remains simple and reliable.

SURVEY OF THE DRAWINGS

Figure 1:
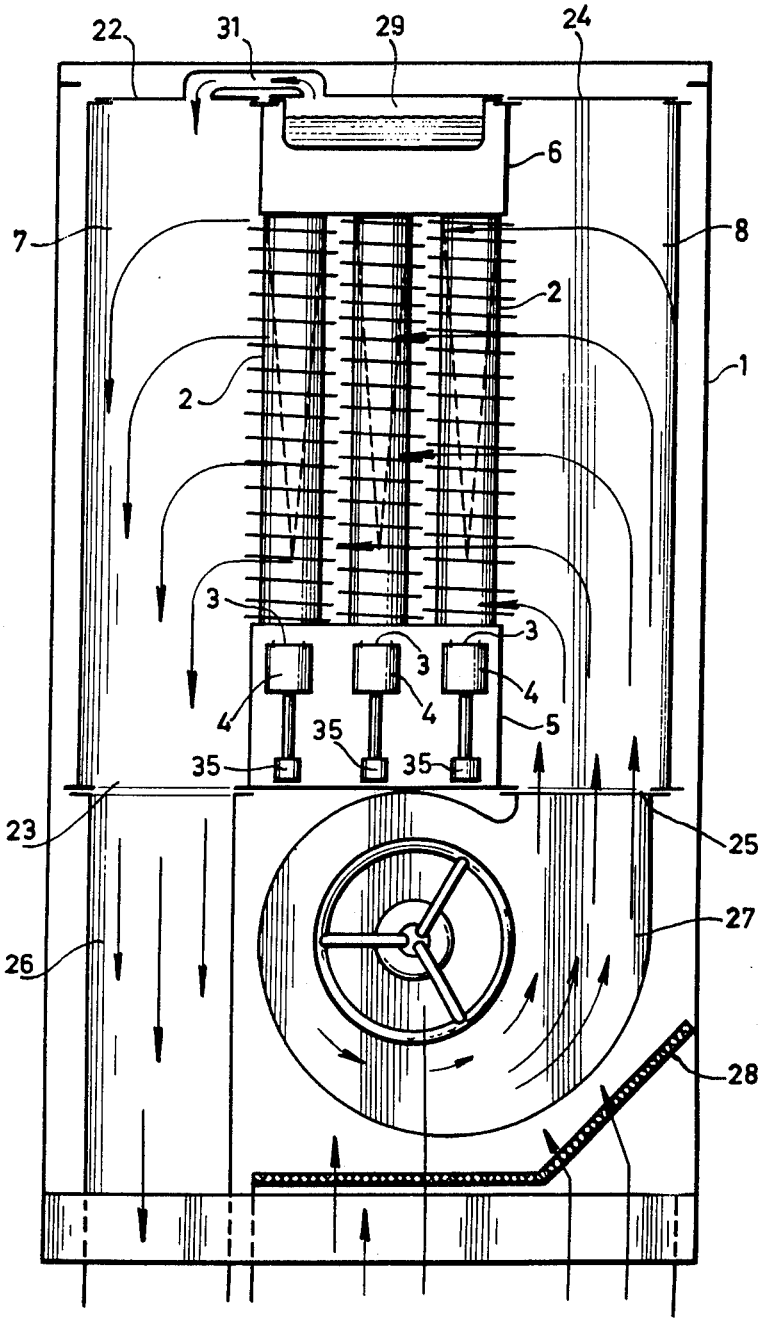
FIG. 1 is a schematic vertical section of an air heater according to the invention, for connection to a central heating system.

The air heater as shown has a sheet metal casing 1 enclosing all vital parts, said casing being interiorly lined with insulating material. The main part of the heater is the heat exchanger compartment, comprising a series of parallel rows of finned vertical tubes 2. These tubes may comprise straight tubes provided with disc shaped or helicals gills but fundamentally may comprise any type of tubes capable of efficient heat transfer between combustion gases flowing through the interior of the tubes and air flowing along the exterior periphery of the tubes. The tubes may for instance have an undulating wall shape, etc.

DESCRIPTION OF PREFERRED EMBODIMENTS

In the embodiment described, the heat exchanger comprises three rows or sections each of which comprises three finned tubes. To facilitate mass production, the three-section-type of air heater is preferred, said type being adapted to the required capacity the number of tubes per section. Each section may for instance have two, three or four tubes.

A burner compartment 5 is mounted underneath the heat exchanger compartment, the burner compartment comprising a separate burner 4 under each row of finned tubes 2 of the heat exchanger. The burners 4 are arranged parallel to each other in the burner compartment 5 and the top of each burner compartment has a series of outlets 3, each of which is coaxial with one of the finned tubes 2 of the appertaining section of the heat exchanger. A common flue compartment 6 is mounted on top of the heat exchanger compartment, all finned tubes 2 opening into said flue compartment.

Two air compartments 7 and 8 for supply and discharge respectively of the air to be heated are mounted at two mutually opposite sides of the unit formed by burner compartment 5, heat exchanger compartment 2 and flue compartment 6. The gas supply pipe with control apparatus 9 is mounted at one of the two other sides of said unit, whereas a duct 10 for the supply of combustion air is mounted at the fourth side of said unit. Thus, a simple, conveniently arranged unit is obtained.

In the embodiment shown, the combustion air supply duct 10 extends from the burner compartment 5 upwardly along the rear side of the heat exchanger compartment, whereas a combined combustion air supply flue gas discharge connection is mounted near the top of the rear side of the heater. The upwardly extending duct 10 opens into the lower compartment 11 of the combined connection 19 whereas the flue compartment 6 opens into the upper part 12 of said connection 19. Said upper part 12 fits with a sliding fit into the rear end of the flue compartment 6 and the connection 19 can be removed, if desired, to be replaced by an ordinary chimney connection piece. Said piece has a rectangular upper part which fits into the rear end of the flue compartment and it has an upper opening which fits into the chimney, but the lower part of the side wall adjacent the part 14 is closed, so as to close the inlet opening at the top of the combustion air supply duct 10. When a chimney connection is used, another inlet opening should be provided in the air duct 10 and this may for instance be obtained by providing a slidable rear wall 17 of the air duct 10 so that said wall 17 may be slide upwardly to provide an opening at the lower end of the duct 10, when the chimney connection 13 is used.

However, the described embodiment of the combustion air inlet and flue gas outlet are meant as an example only and may be replaced by other suitable connection. If the heater is not intended for a balanced flue connection, the outlet of the flue compartment 6 may be connected in any known convenient manner to a chimney inlet whereas the combustion air supply duct 10 may be omitted altogether or may for instance extend halfway up the heat exchanger only. It has been found, however, that a combined connection as shown in FIG. 2, to for instance a ventilation duct in a large building, is permissible for a plurality of heaters to the same ventilation duct without causing an unadmissibly high CO-content in the flue gases, provided the ventilation duct has a sufficient cross section and sufficient air is fed into the duct.

Figure 2:
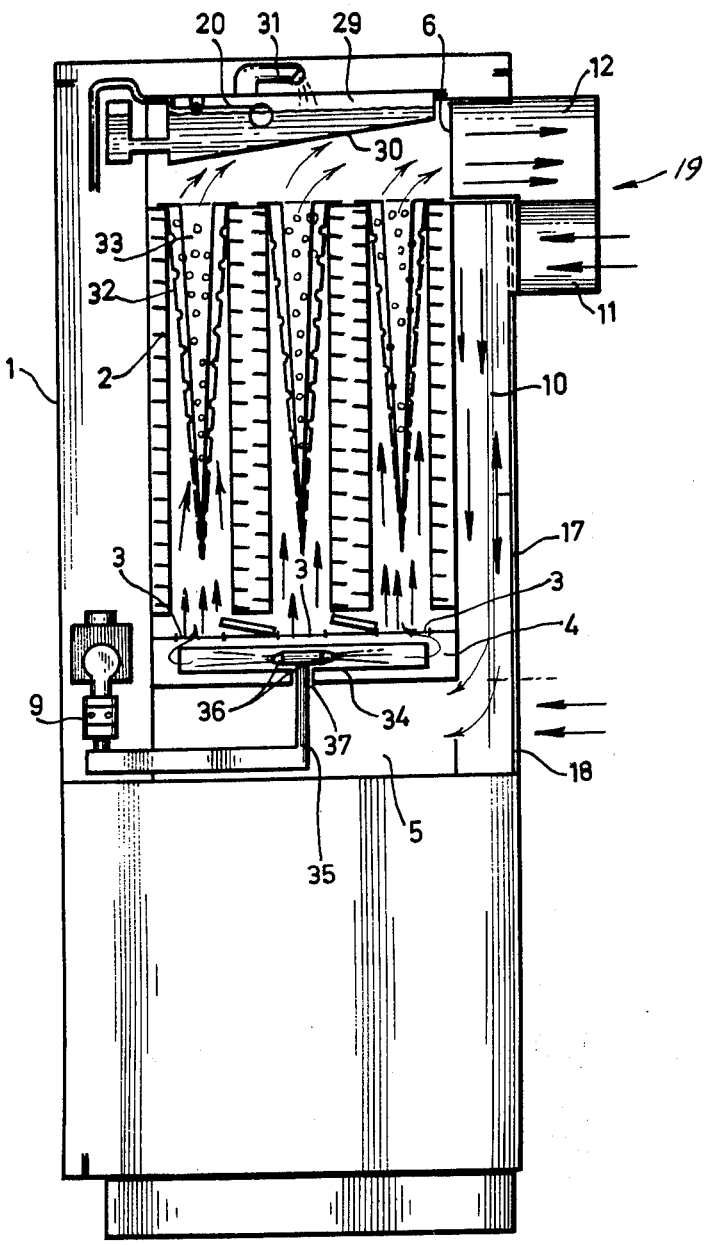
FIG. 2 is a vertical section at right angles to the section of FIG. 1.
Figure 3:
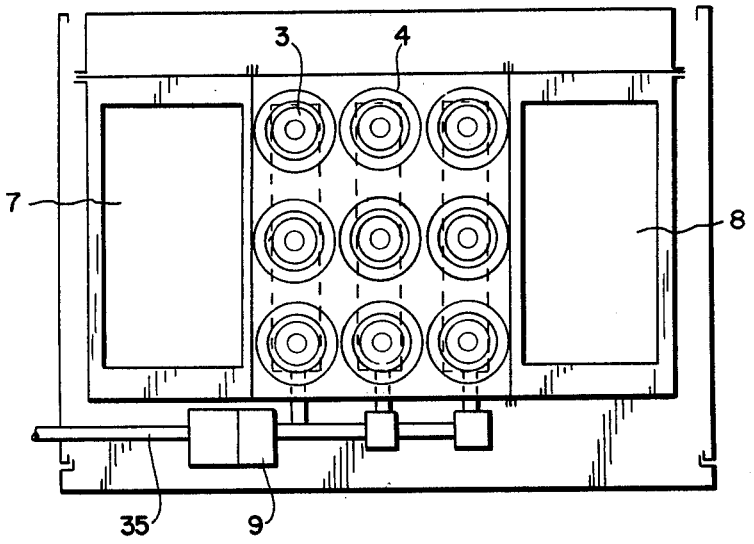
FIG. 3 is a horizontal view of the embodiment of FIGS. 1 and 2.

According to one aspect of the invention, best seen in FIG. 2, the air compartments 7 and 8 at two laterally opposite sides of the heat exchanger compartment are arranged so that even if the available floor space is hardly any larger than the cross section of the heating apparatus, any desired connection can be made with the ducts for circulating the air toward and from the rooms to be heated. The two air compartments 7 and 8 have equal, rectangular cross sections which are closed at their laterally outward sides, so that the air, when looking at FIG. 1, can be fed through the heat exchanging compartment 2 (either from right to left or from left to right) as desired at a particular site for the heater. The air compartment 7 has a connecting aperture 22 in its upper wall and a connecting aperture 23 in its lower wall, whereas the air compartment 8 has a connecting aperture 24 in its upper wall and a connecting aperture 25 in its lower wall. Preferably, the connecting apertures 22 and 24 are of mutually equal configuration and preferably the connection apertures 23 and 25 are also of mutually equal configuration. The connecting apertures 22, 23, 24, 25 are for instance each provided with a circumferential flange having a plurality of bolt holes so that, as desired, anyone of them may be connected to an air duct or to a fan outlet respectively which have similar flanges and bolt holes. Supposing that the air heater is installed on an upper floor of a house, it will usually be advantageous to connect the duct 26 for the heated air with the lower outlet aperture 23 or 25, whichever one of them is most convenient, but if the air heater is installed in the basement of a building, the duct 26 for the heated air will usually be connected to the outlet aperture 22 or 25. The fan outlet 27 is always connected to the air compartment which has no connection for heated air, whereas the other outlet aperture of the same air compartment will be closed by a blind cover, as shown at the upper right corner of FIG. 1 for the outlet aperture 24. Thus, the recirculation air sucked by the fan from the rooms of the building is blown by the fan to a compartment which has no other outlet than the transverse passage through the heat exchanger compartment, so that the recirculated air is reheated upon passing along the exterior of the heated finned tubes, and the reheated air is fed into the opposite air compartment from which it may be discharged either at the top or at the bottom or, if desired, both at the tip and at the bottom. Thus, in FIG. 1 the fan 27 discharges into the lower end of the right side air compartment 8, after which the air flows into the left side air compartment 7 and leaves this compartment via the air discharge duct 26 at the bottom left of FIG. 1. The top of the left side air compartment 7 is closed by a cover 22 provided with a steam outlet 31 for humidifying the heated air, as will be described later on.

Thus, the air heater has a simple, versatile construction and can be installed in cramped quarters according to any of a plurality of different lay-outs, whichever is most suitable for a particular case. In a preferred embodiment, the fan can be mounted in two positions underneath the burner compartment, that is either with its outlet connected to the air compartment 8 or with its outlet connected to the air compartment 7, whereas the main air discharge duct 26 is connectable to the air compartment 7 in the first case and to the air compartment 8 in the second case, in both of which cases one may choose between connection of the duct 26 with the top of the relative air compartment or with the bottom of the relative air compartment. In the embodiment shown in FIG. 1, the main air discharge duct 26 passes through the floor on which the heater is installed, whereas the return duct for the recirculated air is mounted adjacent the duct 26 and passes also through the floor and is connected to the inlet of the fan 27, but it is equally possible to use an elbow shaped main discharge duct 26, which passes through the rear side of the heater as seen in FIG. 1, whereas the fan inlet passes also through said rear side of the heater.

A filter cloth or gauze 28 is mounted in the inlet space of the fan 27 for trapping dust conveyed with the returned air from the heated rooms. Usually, it is sufficient to clean or replace this filter once a year.

A shallow water container 29 is mounted in the top wall of the flue compartment 6, the bottom 30 of said container being preferably inclined upwardly in the discharge direction of the flue gases as shown in FIG. 2. This promotes the heat transfer from the flue gases to the water in the container 29 for providing steam which is fed into a short pipe 31 leading into the air compartment receiving the air heated in the transfer compartment. Preferably, the cover of the upper wall of said air compartment, the steam pipe 31 and the cover of the water tank 29 form a unit which may be rotated over 180° with respect to the position shown in FIG. 1, so as to feed the steam into the other air compartment 8 when the lay-out of the heater is reversed. Although the reversability of the steam connection as described is preferred, it is not essential, since it would also be possible to feed the steam into the air compartment containing the air, which still has to be fed through the heat exchange compartment.

The amount of steam added to the heated air by the device 29, 30, 31 may automatically be controlled by a room hygrostat controlling an electro-valve for closing the water supply to the tank 29, whereas the tank 29 may also be fitted with an automatic level control (float 20). The described humidifying device has the advantages of being simple and cheap, whereas it prevents minerals to be added to the heated air, since the minerals will settle in the tank itself, which may be regularly cleaned. In contrast to this, the usual water jets or wick evaporators cause uncontrollable mineral deposits in the system.

The finned tubes 2 may be provided with retarders to promote the heat transfer from the flue gases to the air circulating exteriorly of the tubes. The retarders may be formed as helical or meander shaped metal stripes extending longitudinally in the tubes 2, but according to the described embodiments, the retarders are shaped as double cones 32, 33 freely suspended in the tubes 2. The hollow cones 32, 33 are made of refractory material or a metal which resists high temperatures. The base, that is the upward end, of the outer cone 32 has lateral projections which support the cone on the upper edge of the tube 2, and the cone is perforated throughout its height. The interior cone 33 is not perforated and the base thereof, that is its upward end, also has lateral projections with which it is supported on the upper edge of the outer cone 32. Thus, the cones 32, 33 are freely suspended for free heat expansion, and they extend over a substantial part of the length of the tubes, the length of the cones being chosen so that the heat load in longitudinal direction of the tube wall is levelled because of the converging shape of the net free passage through the tube. The retarders moreover force the hot gases to flow along the tube wall, they increase radiant heat transfer because of the high surface temperature of the cones and they cause a turbulant flow and thus an improved heat transfer.

As stated, a joint burner 4 extends under each section formed by a single row of tubes 2 extending transversely of the flow of circulating air through the heat exchange compartment. Each burner 4 is provided with a plurality of outlets or burner heads 3 in its upper wall, coaxially with the associated tubes 2. The perforated disc 3 preferably comprises a series of parallel extending corrugated strips separated by straight spacer strips which type of burner is usually called a ribbon burner. This type of burner has the advantage that the percentage of the total area of the burner outlet, which is closed off by the corrugated strips and spacer strips, and thus the free passage percentage with respect to the total area of the burner outlet, can easily be adjusted by selecting a different type of strips. Moreover, the several outlets of each burner may be connected by a narrow slot which is preferably also partially closed by corrugated strips and spacer strips, said slot serving to ensure simultaneous firing of the individual outlets of any burner 4. The casing of the burner 4 may be shaped as an elongated box, in the interior of which extends longitudinally an open ended tube 34 having a central hole 37 in the bottom through which extends a gas supply tube 35. The upper end of the gas supply tube 35 is T-shaped and both ends thereof carry a nozzle 36.

The gas supply tube 35 is connected to a control device 9 comprising an electro-magnetically operated gas shut-off valve. When this valve is opened, the gas flows from both nozzles 36 into the tube 34, where it is mixed with the combustion air flowing into the burner compartment 5. When the mixture leaves the burner housing via the outlets 3 it is ignited by a pilot flame, which may be common for all outlets of any burner and which may even be common for all burners when small flame transfer tubes are installed between the burners.

According to a most important aspect of the invention, there is a separate control device for at least some of the individual burners of the heater, said control devices being connected to a not shown room thermostat. Preferably, the room thermostat is of the multistage type and the individual gas valves of at least some of the burners 4 are connected to individual stages of said multistage thermostat, which stages are set to open and close the associated gas valve at temperatures which are staggered for the successive stages. Thus, each individual section of the heat exchanger is controlled by a simple on-off-procedure, but because of the staggered temperatures at which each stage is switched on and off, the practical result is almost comparable to a proportional control. A proportional control is most desirable with an air heater, because the low heat content of the circulated air, but a real proportional control with for instance gradual lowering of the gas pressure to each burner, is complicated and unreliable. By the staggered control according to the invention, the advantages of a proportional control are approximately obtained but the disadvantages thereof are avoided. On the other hand, the disadvantage of a mere on-off-control, namely that cold air is blown into the rooms when the heater is switched on after an off-period may also be avoided, since the usual daytime-setting of the thermostat may be chosen so that at least one section of the heater remains continuously in operation and further sections are added to the operation according to the requirements by the further stages of the thermostat.

Although an automatic control by a multistage thermostat is preferred, a very simple part-manual multistage control may be used with a three section heater. In this simplified embodiment, a simple thermostat is used which controls a single section but which control may be manually switched so that at moderate outside temperatures a single section is continuously in operation and the thermostat controls the second section by on and off switching, whereas with cold outside temperatures, two sections remain continuously in operation and the thermostat controls the third section by on-off-switching. Thus, this simplified embodiment requires only a hand operated switch in the controller lines from the thermostat to the control valves of the three burners of the heater. It has been found that in moderate climates this simplified embodiment requires manual switching a few times a year only, namely at the beginning and at the end of a cold spell. It will be clear, however, that a fully automatic control by means of a multistage thermostat will be preferable if sharply fluctuating outside temperatures prevail.

There are two main advantages of applicants specific structure as follows: The efficiency of a burner is generally at maximum value when operating under full load. The thermal efficiency may then lie between 75 – 80%. However as soon as the fuel supply is reduced, for instance by throttling the gas supply, the thermal efficiency lowers steeply and will be 40% or even lower. This fact is of great importance, as generally a heater installation for a house, office or the like building is used during 5% of the operating time under maximum load, whereas the remaining 95% of the time the heater is operating at reduced capacity. This causes a bad thermal efficiency of the complete installation.

An important disadvantage of normally existing installations is that by reducing or even cutting out one or more burners, the airstream after having passed through the heat exchanger, will have hotter and cooler zones. These different streams mix very difficulty and will thus cause some discomfort when blowing into the rooms to be heated.

These disadvantages are completely eliminated with applicant's device by the combination of the following features:

a. The heat exchanging elements consist of vertical members having fins on the face which is transmitting the calories to the airstream;

b. The heat exchange elements are mounted in rows positioned perpendicular to the horizontal stream of air to be heated;

c. Each row of burners has its own fuel supply valve so that every row can be cut off independently of the other rows;

d. There is a thermostat control device for the different rows of heat exchanging elements, with a possible exception for the most upstream lying row of elements.

The gist of applicant's control system lies in the fact that every row of heat exchange elements is working at maximum capacity, and that by rising room temperature the most down stream row is cut off completely and by still further rising room temperature a next row is switched off. By lowering room temperature or outside temperature, the unoperative rows are successively started again at full capacity. Due to the transverse position of the rows of heat exchanging elements with respect to the airstream, there will be no hot and cool zones in the airstream during a cut off one or more rows of burners. The operating heat exchanging elements will have their maximum thermal efficiency which may give rise to a notable reduction in energy consumption (gas or liquid fuel).

What I claim is:

1. Air heater comprising a heat exchanger compartment, in which are arranged a series of parallel rows of vertical heat exchange tubes, the lower ends of which are connected to a joint burner compartment and the upper ends of which are connnected to a joint flue compartment whereas two opposite lateral sides of the heat exchanger compartment are connected to air supply and discharge compartments respectively for feeding the air to be heated transversely through said heat exchanger compartment, said rows of heat exchange tubes fixed by a first, a second and a third burner respectively, each burner comprising a casing having a series of outlet apertures in its upper wall, said outlet apertures being partially closed by a series of suspended corrugated strips in conical configuration alternating with straight strips defining the conical configuration, all of the outlet apertures of a burner being mutually connected by a narrow slot partially closed in the same way as the outlet apertures themselves, said burner casings enclosing an open ended horizontal tube in which are centrally mounted two oppositely directed gas nozzles, and multistage thermostat means controlling the individual burners by successive stages set at staggered temperatures.

* * * * *